United States Patent [19]

Fasbender

[11] 3,937,493

[45] Feb. 10, 1976

[54] COLOR CODED LABELS AND FILE FOLDERS

[75] Inventor: David J. Fasbender, Hastings, Minn.

[73] Assignee: The Smead Manufacturing Company, Hastings, Minn.

[22] Filed: Sept. 30, 1974

[21] Appl. No.: 510,288

[52] U.S. Cl. ..... 283/41; 40/23 A; 40/359

[51] Int. Cl. ..... B41f 21/00

[58] Field of Search ..... 283/36–40; 40/23 A, 359, 360

[56] References Cited

UNITED STATES PATENTS

| | | | |
|---|---|---|---|
| 3,473,827 | 10/1969 | Leadbetter | 283/36 |
| 3,734,544 | 5/1973 | Fishkin et al. | 283/56 |

FOREIGN PATENTS OR APPLICATIONS

| | | | |
|---|---|---|---|
| 1,436,239 | 7/1965 | Germany | 40/359 |
| 662,496 | 5/1963 | Canada | 283/36 |

*Primary Examiner*—Lawrence Charles
*Attorney, Agent, or Firm*—Dugger, Johnson & Westman

[57] ABSTRACT

Labels for file folders that each has a self-adhesive backed surface and in a non-folded position has a front surface with a given letter of the alphabet printed on one half and the same letter of the alphabet printed on the other half at right angles to the first mentioned letter for permitting the label to be used either for top tab filing or end tab filing. In either case, with the label properly positioned on the file folder, and the file properly placed in a vertical position in a file cabinet, one letter will be upright on the desired side of the tab to which the label is adhered. Thirteen distinctive colors are keyed to the first 13 letters of the alphabet as a solid block, and the same 13 colors are used for the second half of the alphabet with strips (bands) through the colored portions of the labels. In a second form of the invention, each label has two occurrences of the same letter, but at right angles to one another, on the end portion thereof; and two occurrences of a different letter, but at right angles to one another, on the opposite end portion thereof together with an appropriate color band on the central portion of the label. Each end portion of the label is joined to the central portion along a perforated line to permit tearing off the respective letter (both occurrences) that is not to be used on the label. Again, with the second form of the invention, the label with the appropriate end portion torn off may be used for either top tab filing or end tab filing and have the desired letter in an upright condition.

8 Claims, 10 Drawing Figures

ALPHABET PER SHEET COLOR CODE.

COLOR CODED LABELS AND FILE FOLDERS

BACKGROUND OF THE INVENTION

Color coded labels for file folders.

In the prior art, for example Canadian Pat. No. 662,496, for each letter of the alphabet, two sets of labels would be required where it is desired to have letters in an upright position when files are in vertical positions and some of the files are to be used for top tab filing and others for end tab filing. As a result, more money has to be invested in supplies and more space provided for storage where the user utilizes both top tab and end tab filing, or a distributor has requests for supplying labels for both types of filing. Further, labels such as disclosed in the aforementioned Canadian patent are not suitable for having a name printed thereon. In order to minimize problems such as the above and still provide other advantages, this invention has been made.

SUMMARY OF THE INVENTION

A self-adhesive label having a first portion adherable to the front surface of the panel of a file folder and a second portion adherable to the back surface of the same panel; each portion bearing a given indicia that is at right angles to the same indicia on the other portion.

One of the objects of this invention is to provide a new and novel self-adhesive label adherable to a file folder and bearing given indicia wherein the label may be used on either a top tab file folder or an end tab file folder and have the indicia appear in a normal upright forwardly facing position when the file folder has been filed. In furtherance of the above object, it is a further object to provide labels having separate indicia on opposite end portions thereof and which may be used to display the desired one of the two different indicia in an upright condition on either end tab or top tab file folders when the file folders are properly filed. Still another object of this invention is to provide color coded file folder labels utilizing thirteen distinctive colors that distinctively code all 26 letters of the alphabet.

BRIEF DESCRIPTION OF THE DRAWINGS

Referring to FIGS. 1 and 2, there is disclosed a file folder having a front panel 10 and a back panel 11 that is joined to the front panel along the field line 13. The back panel has a top tab portion 14 that extends further away from the fold line 13 than the terminal edge of panel 10 that is remote from and parallel to the fold line. Further, the back panel has an end tab portion 15 that as shown in FIG. 1, extends further to the right of the front panel than the right hand edge of the front panel. The top tab portion is provided with a plurality of score lines 16, 17 and 18 while the end tab advantageously is provided with a plurality of score lines 19, 20 and 21.

Referring to FIG. 10, each label 25 of the first embodiment of this invention is provided with a central score line 26. The lower part 25A of the label has a first letter (alphabetic character) 27 printed perpendicular to the central fold line 26 while the upper half 25B of the label has the same letter, designated 28, printed horizontal to the fold line. That is, letters 27 and 28 are the same but are on opposite side of the fold line and perpendicular to one another. As a result, as shown in FIGS. 1 and 3, the same label can be used for either top tab or end tab filing with the letters always being in the proper upright position. In using labels 25 for top tab filing the back surface of part 25A is adhered to the front surface of tab portion 14 of panel 11 while the back surface of part 25B is adhered to the back surface of the tab portion 14 of the panel 11 and the fold line 26 extends parallel to and adjacent the free terminal edge of tab 14 that is parallel to the fold line 13. However, for end tab filing, the back surface of part 25B is adhered to the front surface of tab portion 15 while the back surface of part 25A is adhered to the back surface of tab 15 and the fold line 26 extends adjacent to the free terminal edge of tab portion 15 that is perpendicular to fold line 13. As indicated in FIG. 10, thirteen distinctive colors are keyed to respective ones of the first thirteen letters of the alphabet with the coloring being in solid block other than for the two occurrences of the same letter printed thereon. Similarly, the same thirteen colors are utilized for the second half of the alphabet except that instead of having a solid color block other than for the letters, the labels for each of the letters of the second half of the alphabet has one or more white bands (strips) 40 extended thereacross perpendicular to the fold line of the respective label. As shown on FIG. 10, one form of color coding is as follows:

Figure 1:
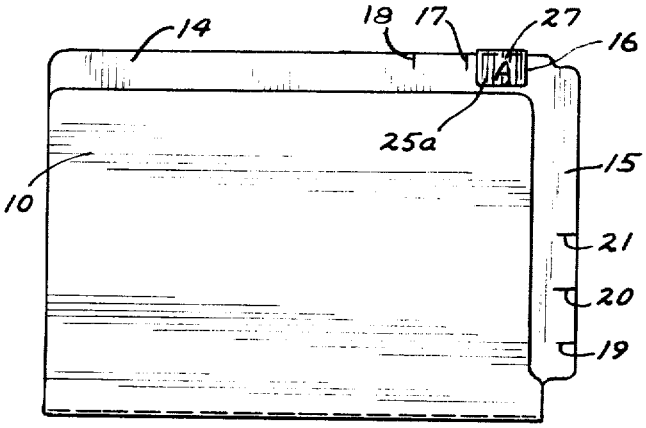
FIG. 1 is a front view of a file folder having a top tab and an end tab, the top tab having a label of the first embodiment of the invention thereon.
Figure 2:
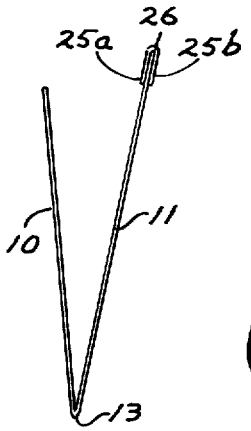
FIG. 2 is an end view of the file folder of FIG. 1.
Figure 3:
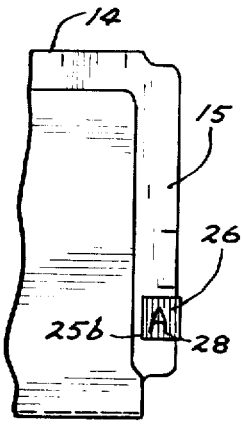
FIG. 3 is a fragmentary end view of the file folder of FIG. 1 other than it shows the label on the end tab.
Figure 4:
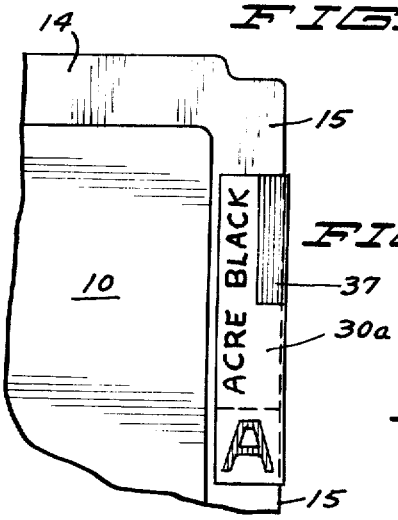
FIG. 4 is a fragmentary view of the folder of FIG. 1 that has a label of the second embodiment of the invention adhered to the end tab thereof and has one set of indicia separated therefrom.
Figure 5:
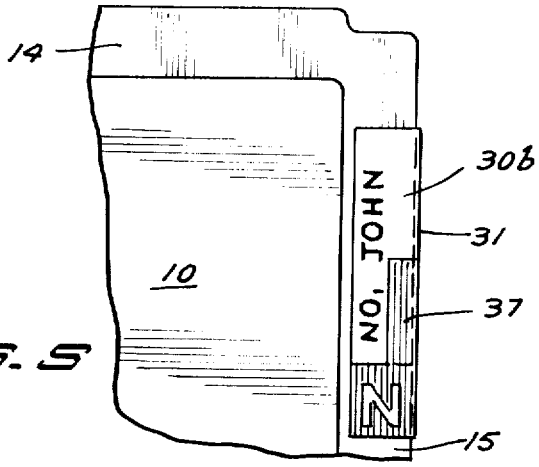
FIG. 5 is a view similar to that of FIG. 4 other than that the label has the indicia shown in FIG. 4 removed therefrom and has the indicia thereon that was separated from the FIG. 4 label thereon.

| | | | |
|---|---|---|---|
| A | red | N | " (white bands |
| B | dark blue | O | " through colors) |
| C | dark green | P | " |
| D | light blue | Q | " |
| E | purple | R | " |
| F | orange | S | " |
| G | grey | T | " |
| H | dark brown | U | " |
| I | pink | V | " |
| J | yellow | W | " |
| K | light brown | X | " |
| L | lavender | Y | " |
| M | light green | Z | " |

Referring now to FIGS. 4–9, each of the labels of the second embodiment of the invention, generally designated 30, in a flat horizontal condition includes a fold line 31 extending the length thereof and has a first part 30A transversely on one side of the fold line and a second part 30B transversely on the opposite side of the fold line. On one longitudinal end portion 30C of part 30B there is printed a first alphabetic character 32 while on the opposite longitudinal end portion 30D there is printed a second alphabetic character 33. Further, the one end portion 30C of part 30A has the same character 32 printed thereon, except that it is at right angles to the character printed on the one end portion of 30B while the opposite end portion 30D has character 33 printed thereon that is the same as that on 30B except at right angles thereto. As may be noted in FIG. 8 the characters 32 which are at right angles to one another are on the same end portion of the label while the characters 33 are on the opposite end portion of the label. A perforated line 35 extends between the end portion of the label bearing the characters 32 and the central portion of the label while a second perforated line 36 separates the end portion of the label bearing the characters 33 from the central portion of the label. Additionally, as may be noted from FIG. 8, the end portion 30D is of a solid color other than for the characters 33 while a color band 37 of the same color as that of portion 30D is formed on the central part of a label to extend from part 30D part way toward the perforating line 35 and to have about a half thereof located on part 30B and the other half located on part 30A. To be mentioned is that the characters 33 are white while the characters 32 are of the same color as the color band 37.

Each of the central parts of parts 30A and 30B intermediate perforated lines 36 and 37 is of a length to have a desired name printed thereon to extend parallel to the fold line 31. Additionally, each of the labels 30 is advantageosly releasably adhered to a release backing sheet 38 whereby a plurality of labels may be adhered to the backing sheet and rolled. As a result, the roll can be inserted into a typewriter and one label after the other have the appropriate name beginning with the one character typed thereon, or the labels removed from the backing sheet and placed in the typewriter for having names beginning with the other character printed thereon.

Figure 10:
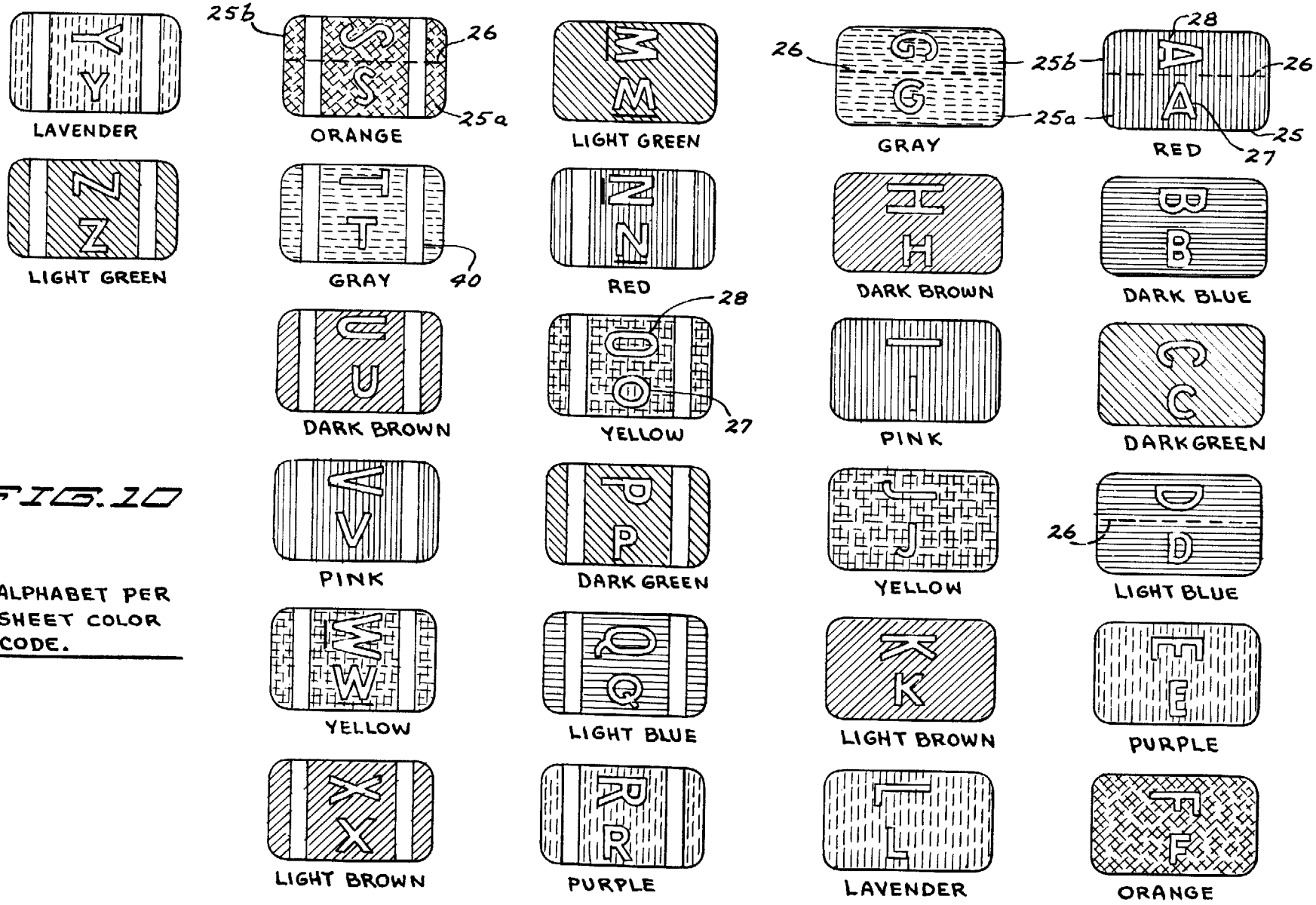
FIG. 10 shows the labels of the first embodiment that are color coded in accordance with this invention the center score lines being illustrated for only a few of the labels.

As an example of the color coding of the labels in the second embodiment, each of the alphabetical characters A through M may be of the same color as the color of the background on the label for the respective letters illustrated in FIG. 10 while the color band would be of the same colors. The letters N through Z would be printed on a colored background that is the same as the colored background (excluding white bands 40) as the corresponding letters of the first embodiment.

Thus, for example, the labels bearing the characters A and N on the front surface thereof would have the characters A in red on end portion 30C and the color band 37 in red on the central portion, end portion 30D in red, except for letters N, and the remainder of the surface of the label white. Similarly, for the characters B and O, the characters B would be dark blue and the color band on the same labels would be dark blue, and the letters O would be white on a dark blue background (see FIG. 9).

Figure 7:
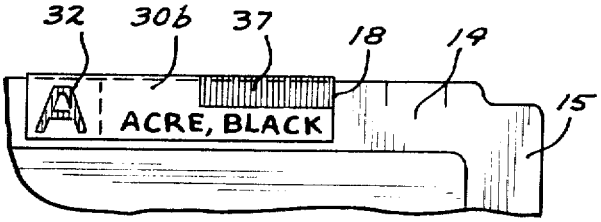
FIG. 7 is a fragmentary view of a file folder having the label of FIG. 4 being utilized for top tab filing.
Figure 8:
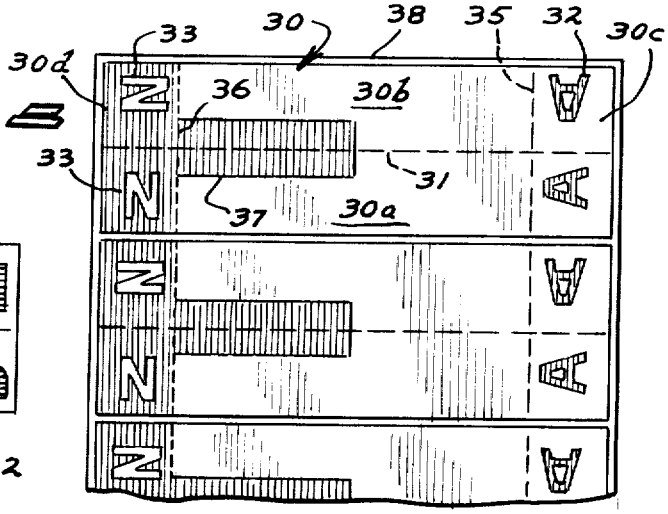
FIG. 8 is a fragmentary view that shows a series of labels of the second embodiment adhered to a backing sheet.
Figure 9:
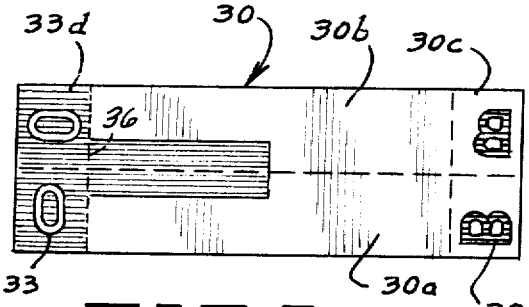
FIG. 9 shows a label of a second embodiment of the invention having second sets of indicia thereon.

In utilizing the labels of the second embodiment wherein the last name of the person begins with A and the label is to be utilized for an end tab folder, the name is typed on the appropriate part of label 30A and the part 30D is severed from the remainder of the label at perforated line 36. Now, the remainder of the label which includes the indicia 32 has part 30A adhered to the front surface of tab 15 and the part 30B adhered to the back surface with the fold line parallel to and adjacent to the free terminal edge of tab 15 that is perpendicular to fold line 13. As a result, when the folder is in an upright condition, the character 32 facing forwardly appears in an upright condition on the lower part of the label and the color band 37 on the upper part and extends around the free vertical terminal edge of tab 15 (see FIG. 4). If the remainder of the label bearing indicia A is to be utilized for top tab filing, then part 30B is adhered to the front surface of tab 14 and part 30A is adhered to the back surface (see FIG. 7). Preferably, the right hand edge of the label as viewed in FIG. 7 is adjacent to the score line 18.

Figure 6:
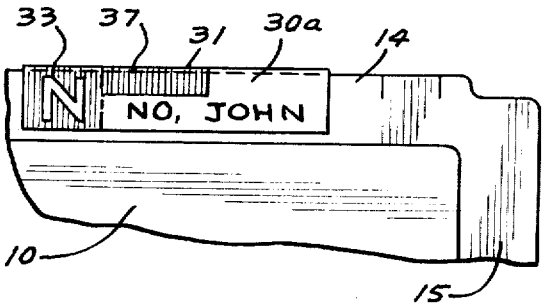
FIG. 6 is a fragmentary view of the file folder having the same label as that shown in FIG. 5 with the label being utilized for top tab filing.

On the other hand, if the last name of the party begins with N, then part 30C is separated from the remainder of the label along score line 35 and discarded. In such an event, the remainder of the label which bears character 33 has part 30A adhered to the front surface of the tab 14 and part 30B adhered to the back surface of tab 14, provided the remainder of the label is to be used for top tab filing such as shown in FIG. 6. If the remainder of the label bearing character 33 is to be used for end tab filing, then part 30B is adhered to the front surface of tab 15 and part 30B adhered to the rear surface (see FIG. 5). As may be noted from FIGS. 4–7, one label may be used for either one of two characters for either top tab or end tab filing, and when the file is upright the respective characters be upright when viewed from the front of the respective file.

When the labels are being used for end tab filing, preferably the bottom edge of the label secured to the end tab is closely adjacent the score line 21. At such time, with file folders properly in the file, the letter A on the appropriate file folder that is facing forwardly is at the same elevation as the letter N on the corresponding file folder. However, as may be noted from FIGS. 4 and 5, the color band 37 for the label on the file folder having A thereon is at a higher elevation than the color band on the file folder having N thereon. Further, the front surface of the lower part of the label on the file folder of FIG. 5 has a background color whereas in FIG. 4 the character itself is color coded.

Thus, for example, in using the second embodiment with the file folders in end tab filing in a vertical position in a vertical end tab filing cabinet, in the event that the file having the character N thereon is mixed in with a series of A files, due to the differences of elevation of the red color bands on the file folders, it would be very easily noticeable that the N file folder was placed in the wrong series of files. Likewise, in top tab filing if an N file folder were placed in with a series of A files, the color band of the N file would be offset from the A files and thereby quite easily noticeable. Of course, if the file with, for example, an N label were placed in a series of files with R labels, the difference in color of the color bands would make it apparent the N label file was misfiled.

In the event an N file folder bearing labels of the first embodiment of the invention were placed in with a series of A file folders, the N file folder white band 40 would stand out and thereby be readily noticeable. In this connection, it is to be noted for end tab filing the labels on the file folders are to be placed between score lines 19 and 20 while for tap tab filing the labels 25 are to be positioned between score lines 16 and 17. This placement of the labels on the file folders is for the spotting of misfiled files. It is to be understood that the labels of this invention can be utilized with file folders other than the specific construction shown in FIG. 1. Further, it is to be understood that the labels could be of a type that do not have adhesive back surfaces; however, it is preferred that the labels have selfadhesive back surfaces.

What is claimed is:

1. For use with either an end tab file folder or a top tab file folder, a file folder label in a flat horizontal condition having a central fold line, a first part on one transverse side of the fold line and a second part on the opposite transverse side of the fold line, said first part having a first character indicia thereon, and said second part having a first character indicia thereon that when the label is in a flat condition is oriented at right angles to the first character on the first part, the first and second part each having a first end portion, a central portion and second end portion, the first end portions being adjacent one another, the first end portions having the first character indicia thereon, the first part second end portion having a second character indicia thereon and the second part second end portion having a second character indicia thereon that is the same as the second character indicia on the first part second end portion and is oriented at right angles relative thereto.

2. The article of claim 1 further characterized in that the orientation of the character indicia on the first end portion of the first part is 180° relative the orientation of the character indicia on the second end portion of the second part.

3. The article of claim 1 further characterized in that the character indicia on the second end portions are of the same colors as the label surface of the first end portions having the first character indicia thereon that surrounds the first character indicia.

4. The article of claim 1 further characterized by the surface of the first end portion having indicia thereon, other than for the indicia thereon is of a given color that contrasts to the color of the second end portions, other than for the indicia thereon.

5. The article of claim 4 further characterized in that each of the central portions has a color band thereon of said given color that is substantially more remotely spaced from one of the first and second end portions than the other end portions, and that the second indicia are of said given color.

6. The article of claim 5 further characterized in that first perforations are located at the juncture of the first end portions with the central portions for facilitating the separation of the first end portions from the central portions, and that second perforations are located at the juncture of the second end portions with the central portions for facilitating the separation of the second end portions from the central portions.

7. For use with either an end tab file folder or a top tab file folder, a file folder label in a flat horizontal condition having a self-adhesive back surface, a central fold line, a first part on one transverse side of the fold line, a second part on the opposite transverse side of the fold line, first and second perforated lines spaced from one another to divide each part into a first end portion, a second portion and a central portion, the central portions being between the first and second perforated lines and the first parts being adjacent one another, the first part first end portion having a first character indicia thereon, the second part first and portion having a first character indicia thereon that is the same as the first character indicia on the first part first end portion and oriented at right angles thereto, the first part second end portion having a second character indicia thereon and the second part second end portion having a second character indicia thereon that is the same as the second character indicia on the first part and oriented at right angles thereto, the character indicia on the first part first end portion being oriented 180° relative the orientation of the character indicia on the second part second end portion, the first and second perforated lines being provided to facilitate the separation of the first end portion from the central portions, and the central portions from the second end portions, respectively.

8. The apparatus of claim 7 further characterized in that the character indicia on the second end portions are of the same color as the label surface of the first end portions surrounding the first character indicia, that the first indicia is of a different color than the second indicia, and that each of the central portions has a color band thereon adjacent the other, of the same color as the character indicia on the second end portions and substantially spaced from the first end portions.

* * * * *